US006820959B1

(12) United States Patent
Spitz et al.

(10) Patent No.: US 6,820,959 B1
(45) Date of Patent: Nov. 23, 2004

(54) INK JET CARTRIDGE STRUCTURE

(75) Inventors: Donald Norman Spitz, Lexington, KY (US); Carl Edmond Sullivan, Versailles, KY (US); David Amos Ward, Lexington, KY (US); Benjamin Alan Askren, Lexington, KY (US); Michael David Lattuca, Lexington, KY (US); Ashok Murthy, Lexington, KY (US); Ronald Monroe Nowell, Jr., Lexington, KY (US); Darrin Wayne Oliver, Lexington, KY (US)

(73) Assignee: Lexmark International, In.c, Lexington, KY (US)

( * ) Notice: Subject to any disclaimer, the term of this patent is extended or adjusted under 35 U.S.C. 154(b) by 809 days.

(21) Appl. No.: 09/089,698

(22) Filed: Jun. 3, 1998

(51) Int. Cl.[7] ..... B41J 29/377; B41J 2/05
(52) U.S. Cl. ..... 347/18; 347/58
(58) Field of Search ..... 347/18, 56, 58, 347/83

(56) References Cited

U.S. PATENT DOCUMENTS

| | | | | | |
|---|---|---|---|---|---|
| 4,296,421 | A | * | 10/1981 | Hara et al. | 347/18 |
| 4,596,994 | A | * | 6/1986 | Matsuda et al. | 347/64 |
| 4,686,544 | A | * | 8/1987 | Ikeda et al. | 347/64 |
| 4,755,836 | A | * | 7/1988 | Ta et al. | 347/49 |
| 4,831,390 | A | * | 5/1989 | Deshpande et al. | 347/18 |
| 4,942,408 | A | * | 7/1990 | Braun | 347/63 |
| 4,956,654 | A | | 9/1990 | Komuro et al. | |
| 5,066,964 | A | | 11/1991 | Fukuda et al. | 346/140 R |
| 5,079,189 | A | * | 1/1992 | Drake et al. | 437/209 |
| 5,084,713 | A | | 1/1992 | Wong | 346/1.1 |
| 5,156,469 | A | | 10/1992 | Tanaka et al. | 400/124 |
| 5,160,945 | A | | 11/1992 | Drake | 346/140 R |
| 5,278,584 | A | * | 1/1994 | Keefe et al. | 347/63 |
| 5,426,458 | A | * | 6/1995 | Wenzel et al. | 347/45 |
| 5,451,989 | A | | 9/1995 | Kadowaki et al. | 347/18 |
| 5,637,166 | A | | 6/1997 | Swanson et al. | 156/73.1 |
| 5,657,061 | A | | 8/1997 | Seccombe et al. | 347/18 |
| 5,834,689 | A | | 11/1998 | Cook | |

* cited by examiner

*Primary Examiner*—Michael S. Brooke
(74) *Attorney, Agent, or Firm*—Luedeka, Neely & Graham, P.C.

(57) ABSTRACT

The invention described in the specification relates to an improved ink jet printer cartridge structure which includes a substrate carrier or nose piece upon which semiconductor devices for ink jet printheads are mounted. The substrate carrier has a top surface containing one or more substrate locator wells each well having well walls, a well base and at least one ink feed slot in each well base and side walls attached to the top surface along the perimeter thereof. One or more of the side walls contain fins for heat removal from the substrate carrier and at least two alignment devices attached adjacent at least one of the side walls for precisely aligning the substrate carrier in a printer carriage. Among the advantages of the substrate carrier is that it provides a suitable means for substrate alignment for multiple substrates, a means for cooling multiple substrates, a means for fixedly or removably attaching the carrier to a ink reservoir body and a means for accurately aligning the carrier and reservoir body in a carriage of a printer.

8 Claims, 6 Drawing Sheets

INK JET CARTRIDGE STRUCTURE

FIELD OF THE INVENTION

The invention relates to a multi-functional device for a print cartridge of an ink jet printer.

BACKGROUND OF THE INVENTION

Thermal ink jet printers use cartridges containing printheads having heating elements on a semiconductor substrate for heating ink so that the ink is imparted with sufficient energy to cause the ink to be ejected through a nozzle hole in a nozzle plate attached adjacent to a semiconductor printhead substrate. The nozzle plate typically consists of a plurality of spaced nozzle holes which cooperate with individual heater elements on the substrate to eject ink from the cartridge toward the print media. The number, spacing and size of the nozzle holes influences the print quality. Increasing the number of nozzle holes on a printer cartridge typically increases the print speed without necessarily sacrificing print quality. However, there is a practical limit to nozzle bole or orifice size and to the size of the semiconductor substrate which can be produced economically in high yield. Thus, there is a practical limit to the number of corresponding nozzle holes which can be provided in a nozzle plate for a printhead.

For color printing applications, the three primary colors of cyan, magenta and yellow are used to create a palette of colors. Typically, all three colors are provided by a single printhead or chip and a single nozzle plate attached to the printhead. However, this results in relatively slow print speeds because each color swath is small due to the size of the portion of chip being used for that color. In order to obtain suitable substrate production yields, the printheads or chips cannot be large enough to contain the same number of energy imparting devices as would be found on individual printheads for each color.

In an effort to increase printing speed, separate printheads and nozzle plates for each color are attached to separate cartridges. In such a design, the number of nozzle holes per color is maximized for high quality, higher speed printing. However, it is extremely difficult to maintain an alignment tolerance of a few microns between the printheads when using separate cartridges for each color.

While locating multiple individual substrates of a conventional size on the same cartridge may allow a relatively faster printing rate, such a design contributes to significantly increasing the printhead and cartridge temperatures because of the greater number of energy imparting devices located on the printhead and the desire to eject the ink from the cartridge at a faster rate. Increased printhead and cartridge temperatures cause problems with ink ejection due to viscosity changes in the ink resulting in oversize ink droplets and well as premature ejection of ink from a nozzle hole. Higher temperatures may also contribute to air bubble formation in the ink chambers of the printhead which air bubbles inhibit ink droplet formation. Plugging of the nozzle holes by a build up of ink decomposition products adjacent the nozzle holes may also be a problem caused by higher printhead and cartridge temperatures. Furthermore, without adequate temperature control, dimensional changes in the printhead are not predictable making it difficult to achieve the desired dot placement which adversely affects print quality.

Various materials and methods have been proposed for removing heat from the printhead substrates and cartridges.

For example, U.S. Pat. No. 5,084,713 to Wong describes flowing ink from the reservoir through a support panel for the heater substrate to cool the printhead. Such a design requires an adequate flow of ink to the printhead in order to remove sufficient heat therefrom.

U.S. Pat. No. 5,066,964 to Fukuda et al. describes the use of flowing ink in combination with a heat capacity member to remove ink from the printhead in order to cool the printhead. U.S. Pat. No. 5,657,061 to Seccombe et al. describes the use of a heat exchanger in the ink flow path to cool the ink and thus cool the printhead as the ink flows to the substrate. Other methods of removing heat include the use of a heat pipe and blower as described in U.S. Pat. No. 5,451,989 to Kadowaki et al.

Conventionally, materials which exhibit a low thermal expansion coefficient have been used to provide suitable heat removal without sacrificing print quality. Materials having low thermal expansion coefficients do not typically expand or contract a sufficient amount to affect printer operation and thus print quality. The materials also enable easier and cheaper printhead and cartridge fabrication techniques since expansion and/or contraction of the components and electrical connections therebetween is minimized. However, such materials are typically made from exotic composite materials such as metal-ceramic mixtures, carbon fiber, or graphite composites which are costly to make and use in such applications.

An object of the invention is to provide an improved ink jet printer cartridge structure.

Another object of the invention is to provide a single print cartridge containing multiple chips or semiconductor substrates thereon for color printing.

Still another object of the invention is to provide a method for improving print quality in a multi-color print cartridge.

A further object is to provide a multi-color print cartridge for a thermal ink jet printer which provides improved print quality at a relatively lower cost than conventional print cartridges.

Another object is to provide a multi-color print cartridge which contains a device for precisely locating chips for each of the primary colors.

Still another object of the invention is to provide a multi-function print cartridge structure which provides efficient heat removal from the chips and a locating surface for aligning multiple chips thereon.

Yet another object of the invention is to provide a rigid, substantially planar surface for accurately mounting and aligning the semiconductor substrates, nozzle plates and electrical tracing thereon.

SUMMARY OF THE INVENTION

With regard to the above and other advantages, the invention provides an ink jet print cartridge structure containing one or more semiconductor substrates mounted on a substrate holder, the substrate holder having a top surface having a perimeter and containing one or more substrate locator wells, each well having a plurality of well walls and a well base, each well base including at least one ink feed slot therein, the holder also having side walls attached to the top surface along the perimeter thereof, wherein one or more of the side walls contain fins for convectively removing heat from the substrate carrier. It is preferred that the substrate holder be molded, cast or machined for precision and it is particularly preferred that the substrate holder be made substantially of metal.

In another aspect, the invention provides a method for making a print cartridge for a multi-color thermal ink jet printer which comprises providing multi-function substrate carrier and ink reservoir body, the substrate carrier having a top surface containing one or more substrate locator wells each well having well walls, a well base and at least one ink feed slot in each well base, side walls attached to the top surface along the perimeter thereof wherein one or more of the side walls contain fins for heat removal from the substrate carrier and at least two alignment devices adjacent one of the side walls for precisely attaching the substrate holder and reservoir body to a printer carriage, mounting two or more semiconductor substrates containing a plurality of resistive elements and attached nozzle plates in the wells adjacent the well base of the substrate carrier, attaching a TAB circuit or flex circuit to the semiconductor substrates and the top surface of the substrate carrier for energizing the resistive elements on the substrates and inserting one or more ink containers into the ink reservoir body.

Yet another aspect of the invention provides a nose piece for an ink jet printer cartridge, the nose piece comprising a machined, molded or cast, substantially metal structure having a top surface containing one or more substrate locator wells each well having well walls, a well base and at least one ink feed slot in each well base, side walls attached to the top surface along the perimeter thereof wherein one or more of the side walls contain fins for heat removal from the substrate carrier, a plurality of slots along the perimeter of the side walls for precisely attaching the substrate holder to an ink reservoir body and at least two alignment devices adjacent one of the side walls for precisely aligning the substrate holder and reservoir body to a printer carriage, wherein the metal is selected from the group consisting of aluminum, beryllium, copper, gold, silver, zinc, tungsten, steel, magnesium and alloys thereof.

The apparatus and method of the invention provide the means for effectively removing heat from the printhead and print cartridge thereby improving printer performance, operation and reliability. Adequate cooling of the cartridge components is particularly important for cartridges containing multiple printheads, particularly with the increased number of energy imparting devices on each printhead substrate and with the increased firing speed of the energy imparting devices.

By providing a nose piece or substrate carrier and/or ink reservoir body for inserting separate ink containers therein, materials having more effective heat removal than plastic may be used for the nose piece and/or reservoir body. Such materials include not only exotic composite materials such as those containing a high content of carbon fibers or graphite and metal-ceramic materials, but also relatively inexpensive metals such as aluminum, zinc, copper and alloys thereof which possess relatively high thermal conductivities and having relatively high thermal expansion coefficients. Such metals and alloys may be used to provide an effective heat transfer medium for cooling the print cartridge components.

BRIEF DESCRIPTION OF THE DRAWINGS

Further advantages of the invention will become apparent by reference to the detailed description of preferred embodiments when considered in conjunction with the following drawings, which are not to scale so as to better show the detail, in which like reference numerals denote like elements throughout the several views, and wherein.

DETAILED DESCRIPTION OF THE INVENTION

Figure 1A:
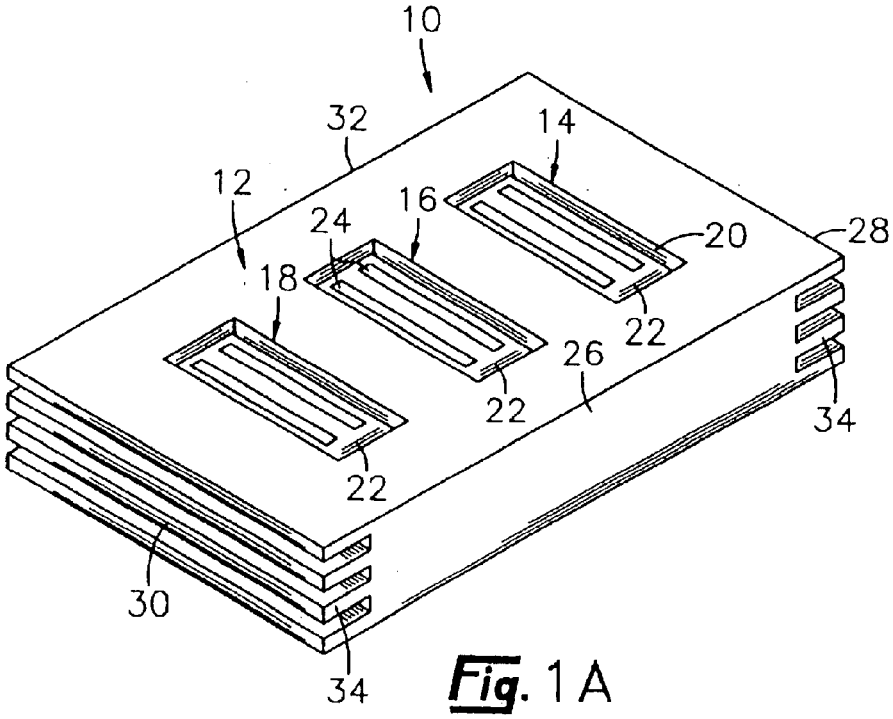
FIGS. 1A and 1B are perspective views from the top and bottom, respectively, of a substrate carrier according to the invention.
Figure 1B:
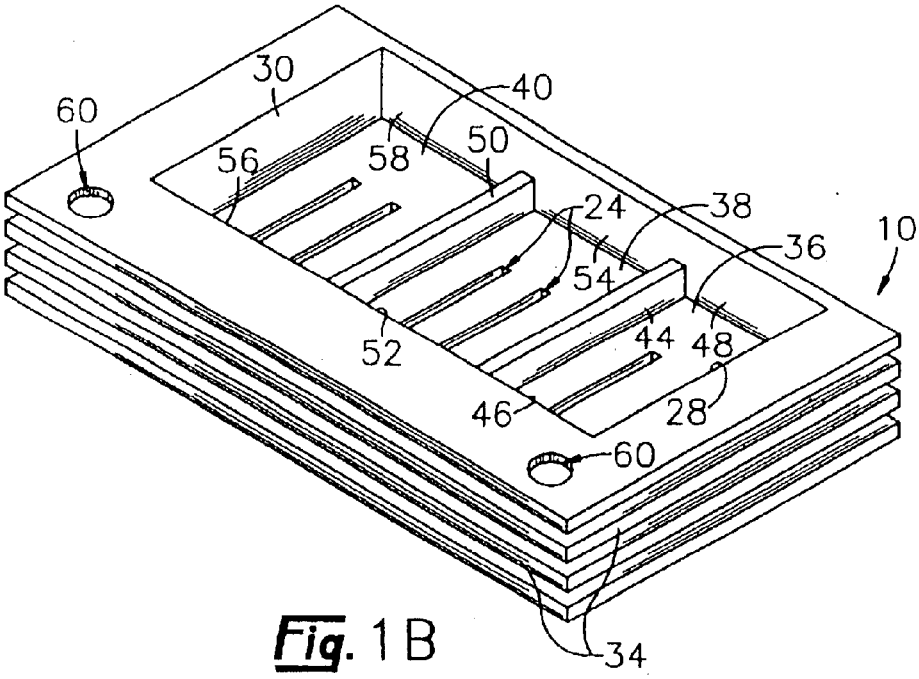

With reference now to FIGS. 1A and 1B there is shown, in perspective views, a substrate carrier or substrate holder 10 according to the invention. The substrate carrier is preferably a one-piece construction made of a cast, machined or molded material having a top surface 12 containing one or more substrate locator wells 14, 16 and 18, each well having well walls 20 and a well base 22. The carrier also preferably contains side walls 26, 28, 30 and 32 which are adjacent and preferably attached to the top surface along the perimeter thereof. The substrate carrier may be made of a variety of materials including composite materials made of carbon fibers, graphite, metal-ceramic materials and metals. The preferred material for the substrate carrier is a metal material selected from aluminum, beryllium, copper, gold, silver, zinc, tungsten, steel, magnesium and alloys thereof.

The wells 14, 16 and 18 define the location of one or more semiconductor substrate chips which are adjacent and preferably attached to the carrier 10 at the base 22 of the wells 14, 16 and 18 preferably by means of a heat conductive adhesive such as a metal-filled or boron nitride filled adhesive having a conductivity ranging from about 0.5 to about 10 watts per meter per EK, preferably about 2 to about 4 watts per meter per EK. Suitable adhesives include POLY-SOLDER LT available from Alpha Metals of Cranston, R.I. and a die bond adhesive containing boron nitride fillers available from Bryte Technologies of San Jose, Calif. under the trade designation G0063.

The size of each well 14, 16 and 18 is preferably such that it can accommodate semiconductor chips ranging in size from about 2 to 5 millimeters wide and from about ¼ inch to about ½ inch long or longer, depending on the ability to produce longer chips. Each well 14, 16 and 18 contains one or more apertures or ink feed slots 24 in the bottom or base of the wells 22 thereof which enable ink from an ink reservoir to flow to the energy imparting areas of the chips or substrates either around the edges of the chips or through generally centrally located vias in the chips. The energy imparting areas of the chips may be provided as by resistive or heating elements which heat the ink or piezoelectric devices which induce pressure pulses to the ink in response to a signal from a printer controller.

As shown, the carrier 10 is preferably a shaped, molded or machined device which may contain cooling fins 34 along one or more sides 28 and 30 thereof for convective cooling of the carrier 10. The cooling fins 34 can have a variety of shapes and orientations and are preferably machined, molded or cast into the carrier 10. Separate cooling fin structures may also be fixedly attached to one or more of the side walls 26, 28, 30 or 32 as by use of heat conductive adhesives, solder and the like.

Each well 14, 16 or 18 is associated with a corresponding chamber 36, 38 and 40 respectively as shown in FIG. 1B. Chamber 36 is defined by side wall 28, partition wall 44 and end walls 46 and 48. Chamber 38 is defined by partition walls 44 and 50 and end walls 52 and 54. And chamber 40 is defined by partition 50, side wall 30 and end walls 56 and 58.

An improved print cartridge according to the invention includes carrier 10 attached to or formed integral with an ink reservoir body or ink container holder which contains an ink supply source for feed of ink to chambers 36, 38 and 40 of the carrier 10. When the carrier 10 is provided as a separate component from the ink reservoir body, the carrier is preferably provided with alignment marks or devices which correspond to alignment marks or devices on the reservoir body used for aligning the carrier to the body. As shown in FIG. 1B, carrier 10 is provided with alignment holes, slots or marks 60 which provide essentially accurate placement of the carrier on the reservoir body by aligning the holes, slots or marks 60 with corresponding marks or projections on the body. Other projections, marks or slots may be used to align the carrier and reservoir body relative to one another.

Figure 2A:
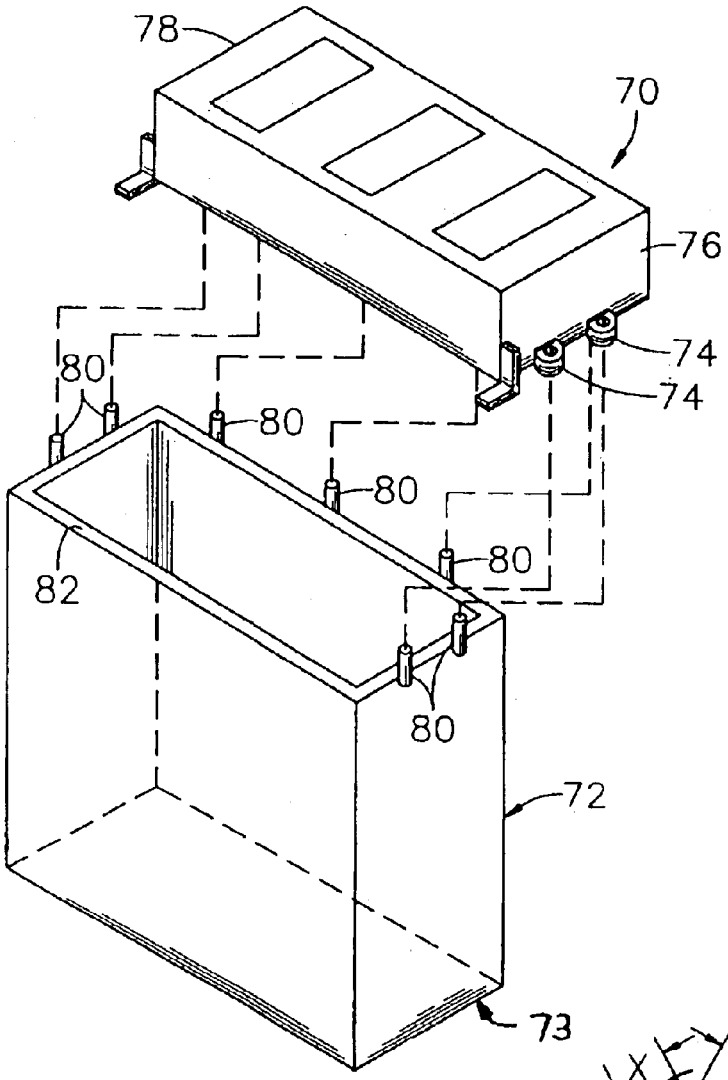
FIG. 2A is a perspective view of a method according to the invention for attaching a substrate carrier to an ink reservoir body.

Referring now to FIG. 2A, there is shown in perspective view a carrier 70 and ink reservoir body or ink container holder 72 which is preferably made of a thermoplastic material. The carrier 70 contains alignment marks, slots or holes 74 which are adjacent a lower end of side walls 76 and 78 and which align with tabs, tenons or projections 80 which are adjacent the top perimeter 82 of the reservoir body or holder 72, the tabs 80 being preferably made of the same material as the holder 72. The tabs 80 are shown along three sides of the reservoir body 72 but may be along all four sides or only on two sides of the top perimeter 82 of the body 72. It is preferred that the slots or alignment holes 74 be somewhat larger than the tabs or projections 80 in order to allow for adjustment of the carrier relative to the body 72.

Figure 2B:
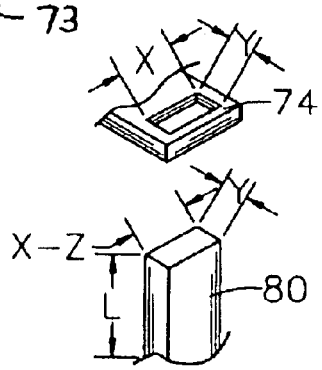
FIG. 2B is an enlarged perspective view of one of the tabs or tenons used for aligning and attaching a substrate carrier to an ink reservoir body for an ink jet printer cartridge.

In FIG. 2B, tab 80 is illustrated as a rectangular tab. When rectangular tabs are used, it is preferred to have the slots 74 slightly oversize in only one dimension and relatively the same size as the tabs in the other dimension so that tab 80 can only move in one direction in slot 74 and is relatively immovable in the other direction. For example slot 74 may have a length x and a width y and tab 80 may have a length (x-z) and a width y which is substantially the same as width y of slot 74. In this example, tab 80 may move in slot 74 relative to the x dimension thereof and is substantially restrained from moving relative to the y dimension thereof. By providing multiple slots 74 adjacent at least two opposing side walls of the carrier 70 and multiple tabs 80 along the perimeter 82 of the reservoir body 72 corresponding to the slots, precise alignment of the carrier 70 to the body 72 may be obtained.

The tabs 80 are preferably made of the same material as the body 72, most preferably a thermoplastic material and have a length L which is sufficient to allow a portion of the tab to extend above the slot 74 when tab 80 is fully mated with its corresponding slot 74. Once the carrier 70 is precisely aligned to the body 72, the ends of the tabs 80 are deformed or melted to fixedly attach the carrier 70 to the body 72. Other means for fixedly attaching the carrier 70 to the reservoir body 72 may also be used including adhesives and fasteners such as bolts and screws. However, regardless of the attachment means, it is preferred to have a plurality of alignment devices on the carrier 70 and body 72 so that precise alignment between the parts can be obtained.

It will be recognized that the carrier 70 and ink reservoir body 72 may be provided as a single cast or molded component so that attachment of one to the other is not necessary. In such a case, one or more of the side walls 26, 28, 30 and 32 (FIG. 1A), preferably at least three of the side walls may be extended to provide a suitable holder for inserting one or more ink containers therein.

Regardless of whether the carrier 70 and reservoir body 72 are provided as separate components or a single component, the reservoir body 72 preferably has an open end 73 for inserting one or more ink containers therein. The ink containers may be filled with liquid ink or a foam element saturated with ink. The containers have openings therein for mating with the chambers 36, 38 and 40 on the underside of the carrier 10 (FIG. 1B) in order to provide ink through the ink feed slots 24 (FIG. 1A) to the substrate chips mounted on the surface of the carrier 10. It is preferred that the ink containers be removably attached to the reservoir body 72 and held in the body by means of a detent on the container and slot on the body. Other means for removably attaching the ink container to the reservoir body may also be used.

Figure 3A:
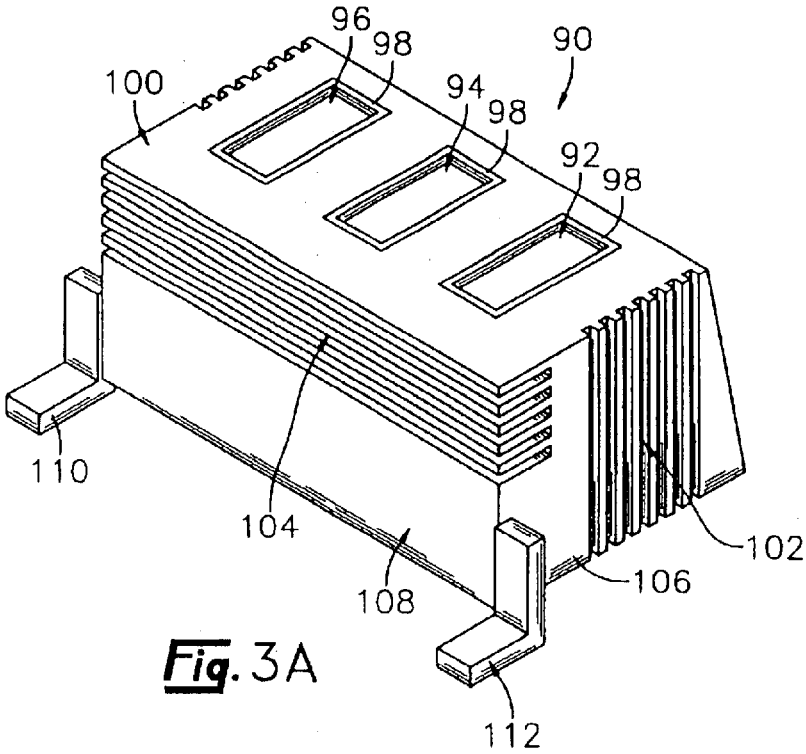
FIGS. 3A and 3B are perspective views from the top and bottom, respectively, of another substrate carrier according to the invention.

FIG. 3A is a top perspective view of another carrier 90 according to the invention. In this design, wells 92, 94 and 96 contain perimeter side walls 98 which surround the wells 92, 94 and 96 and extend up above the planar surface 100 of the carrier 90 a distance of from about 25 to about 1000 microns, preferably from about 50 to about 150 microns or the thickness of a TAB circuit, flexible circuit or printed circuit board used to connect a semiconductor substrate in each of the wells 92, 94 and 96 with a printer controller. Nozzle plates which are attached to the semiconductor substrates are attached to the top of the side walls 98 of each well. In this manner, all of the electrical components attached to the carrier preferably lie within a plane below the plane of the nozzle plate and thus allow the printhead to be placed in close adjacency with the media to be printed, typically within about 40 mils of the media.

Also illustrated in FIG. 3A are the cooling fins 102 and 104 along side walls 106 and 108 respectively. Fins 102 have a planar vertical or perpendicular orientation relative to surface 100 of the carrier 90 and fins 104 have a planar horizontal or parallel orientation relative to the surface 100. The actual orientation of fins 102 and 104 on side walls 106 and 108 is not critical to the invention and may be reversed. Furthermore, any suitable fin configuration may be used. For example, the fins may be pin fins which may be aligned in rows or staggered to provide additional cooling air turbulence.

Another feature of the carrier 90 according to the invention is the carriage positioning devices 110 and 112 attached to the carrier adjacent at least one side thereof. The carriage positioning devices 110 and 112 accurately align the substrate carrier 90 and thus the substrates themselves to the printer carriage so that the precise location of each nozzle hole in the nozzle plates is maintained as the print cartridge containing carrier 90 is attached and removed from the carriage. The printer carriage functions to move the printheads and cartridge in a desired manner across the paper as ink is ejected from the cartridge.

The carriage positioning devices 110 and 112 are shown adjacent side wall 108 of the carrier containing fins 104. However, the positioning devices 110 and 112 may be on the opposite side of the carrier from side wall 108 containing fins 104. It is preferred that the carrier 90 include at least one side wall having a relatively smooth planar surface which is devoid of fins and which is sufficient to provide an electrical contact surface for connecting the printhead electrical devices via a TAB circuit, flexible circuit or printed circuit board to the printer when the print cartridge is properly installed in the printer carriage.

Figure 3B:
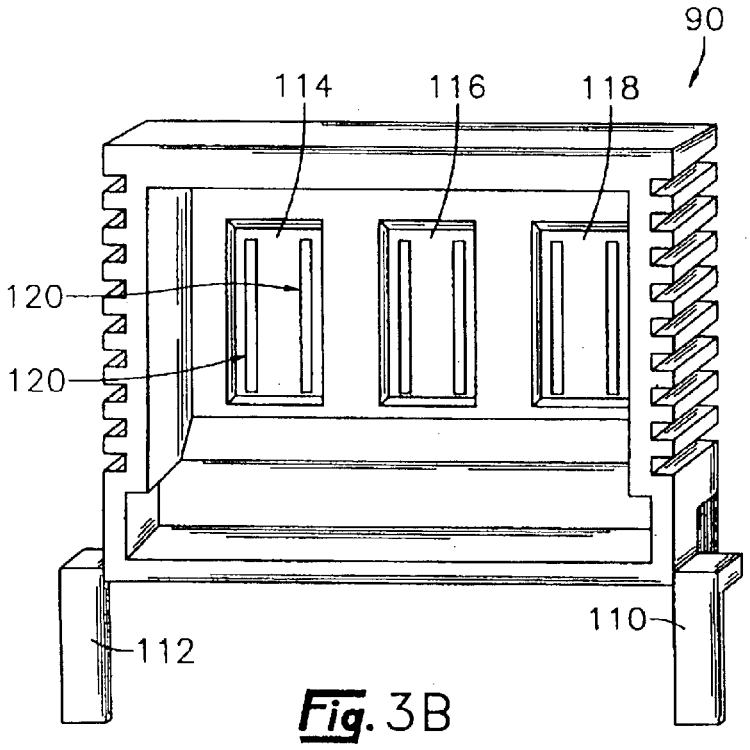

FIG. 3B is a bottom perspective view of the carrier of FIG. 3A. Shown in FIG. 3B are chambers 114, 116 and 118 corresponding to wells 92, 94 and 96 (FIG. 3A). Chambers 114, 116 and 118 provide recessed areas which can be used to isolate or effectively prevent ink of one color associated with one chamber from mixing with ink of a different color associated with an adjacent chamber. The chambers 114, 116 and 118 also provide void areas which may be filled with ink so that a substantially continuous supply of ink will be provided to the substrates positioned in wells 92, 94 and 96 through ink feed slots 120.

Figure 4A:
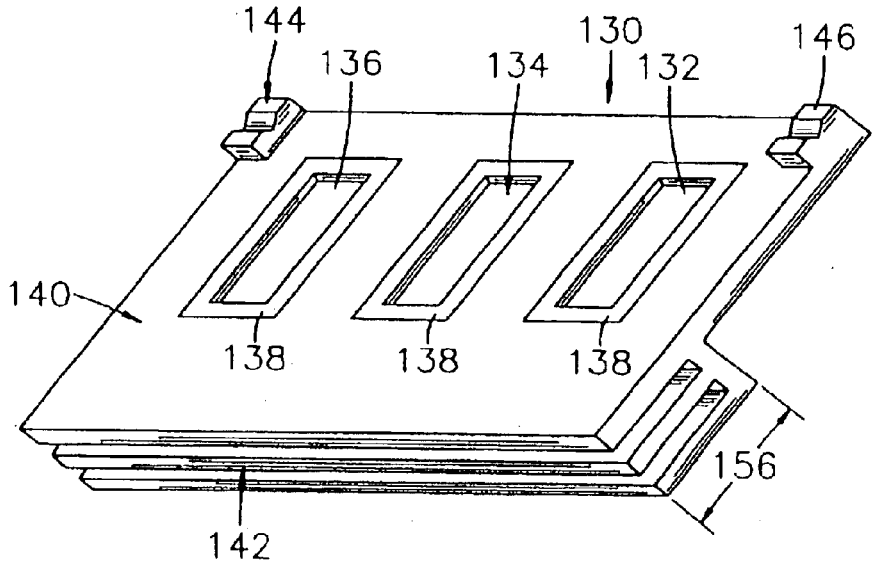
FIG. 4A is a top perspective view of another substrate carrier according to the invention.
Figure 4B:
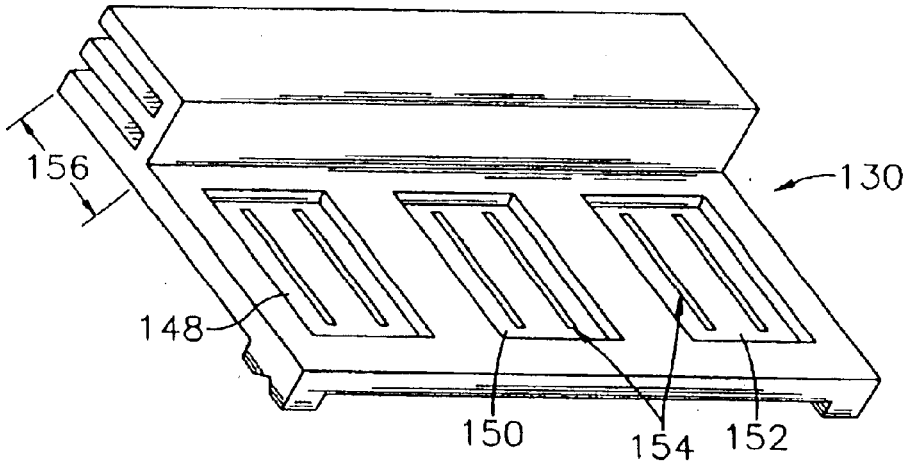
FIG. 4B is a bottom perspective view of the substrate carrier of FIG. 4A.

FIGS. 4A and 4B illustrate an alternative design of substrate carrier 130 according to the invention. FIG. 4A is a top perspective view of the carrier 120 showing substrate pockets or wells 132, 134 and 136 generally as described above having well walls 138 around the perimeter of each well which extend above the planar surface 140 of carrier 130 from 25 about to about 1000 microns, preferably from about 50 to about 150 microns.

In the design illustrated in FIG. 4A, the cooling fins 142 have a generally horizontal orientation with respect to surface 140 and are adjacent only one side of the carrier 130. Carriage positioning devices 144 and 146 project from surface 140 and provide positioning of the carrier and ink reservoir body with respect to a printer carriage.

A bottom perspective view of the carrier 130 of FIG. 4A is given in FIG. 4B. As with the carrier design described with reference to FIGS. 3A and 3B, the carrier 130 also contains chambers 148, 150 and 152 corresponding to wells 132, 134 and 136 respectively. At least one ink feed slot 154 is associated with each chamber 148, 150 and 152 and each well 132, 134 and 136 to provide ink flow from an ink container or ink reservoir to the semiconductor substrates in each well.

In order to provide sufficient heat transfer area, fins 142 are preferably relatively long and are formed in a carrier extension area or shelf 156 of the carrier 130. The shelf 156 also serves as a planar surface for printer contacts to contact connection pads on a TAB circuit, flexible circuit or printed circuit board attached to the substrates in the wells.

Figures 5A, 5B:
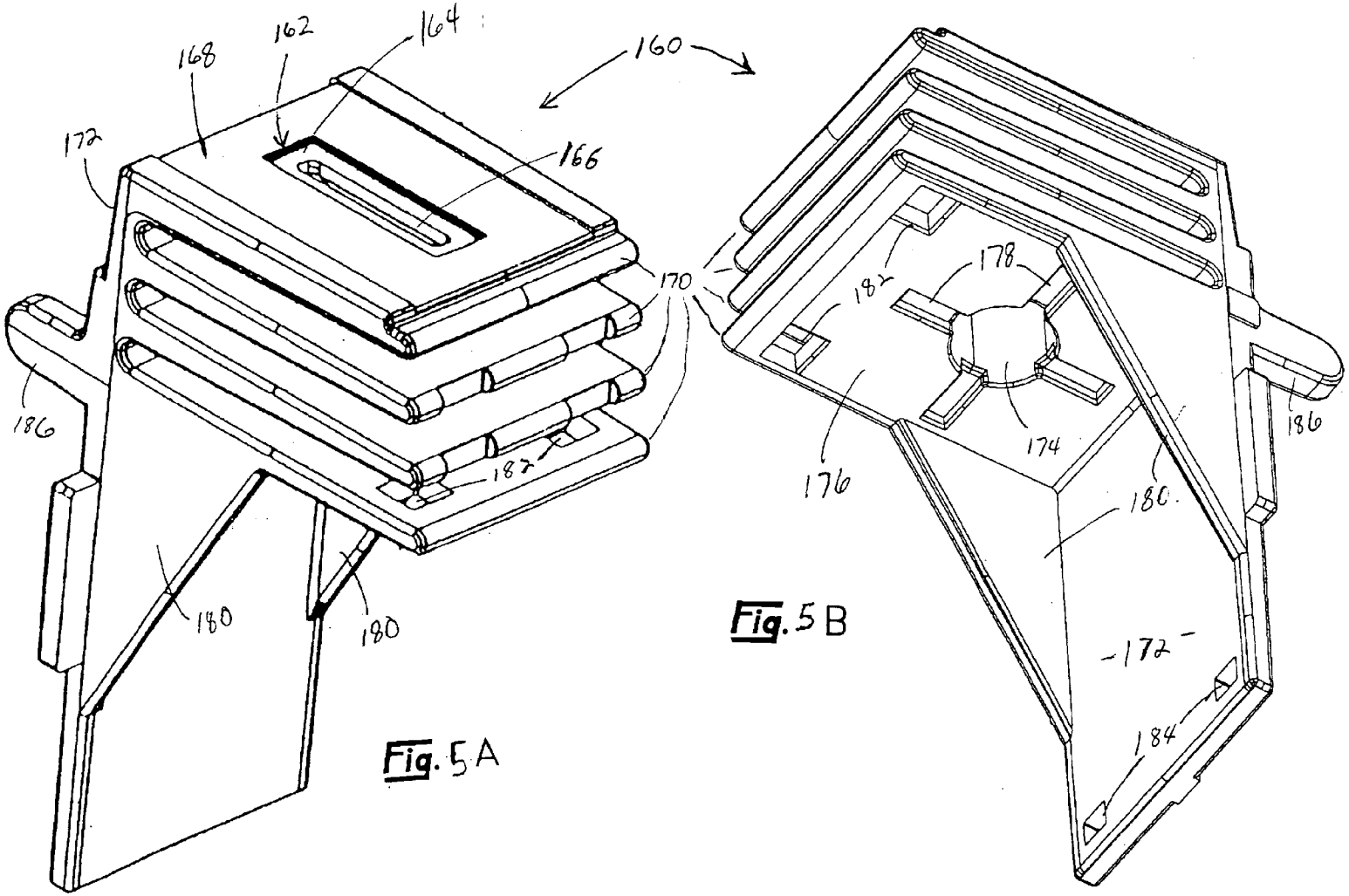
FIGS. 5A and 5B are perspective views from the top and bottom, respectively, of another substrate carrier according to the invention.

With reference now to FIGS. 5A and 5B, there is shown, in top and bottom perspective views, yet another substrate carrier 160 according to the invention. The design illustrated in FIGS. 5A and 5B is for attaching a single semiconductor substrate chip in well 162, however, a multiple chip design similar to the design of FIGS. 1–4 is contemplated by the design. As with the previous designs, a semiconductor chip is attached to the base 164 of well 162 by means of a heat conductive adhesive, described above. The base 164 of well 162 contains one or more apertures 166 for feed of ink from an ink reservoir to the chip.

The planar surface 168 of carrier 160 provides an adhesive bonding surface for attaching a TAB circuit, flexible circuit or printed circuit board to the carrier 160 for electrical connection to the energy imparting devices on the chips. As with the previous designs, it may be desirable to include well walls adjacent well 162 which extend above the planar surface 168 of the carrier a distance substantially equal to the thickness of the TAB circuit, flexible circuit or printed circuit board and adhesive layer in order to reduce corrosion of the electrical circuit which may be caused by the ink.

Fins 170 extend continuously around at least three sides of the carrier 160 and provide a significant heat transfer surface area for convective transfer of heat from the carrier. The fourth side 172 of the carrier is substantially devoid of fins and provides a planar surface for printer contacts to contact connection pads on the TAB circuit, flexible circuit or printed circuit board.

An important feature of carrier 160 is illustrated in FIG. 5B. Rather than having a relatively open rectangular area, as shown in FIG. 3B, the ink supply chamber 174 is a cylindrical opening for insertion therein of a cylindrical filter element. The ink supply chamber 174 transitions from a cylindrical opening on the ink supply side 176 of the carrier to the rectangular ink feed slot or slots 166 in the well 162. One or more, preferably at least two, and most preferably at least four filter alignment notches 178 extend radially from the supply chamber 174 and provide a means for effectively aligning the filter element in the supply chamber.

Figure 5C:
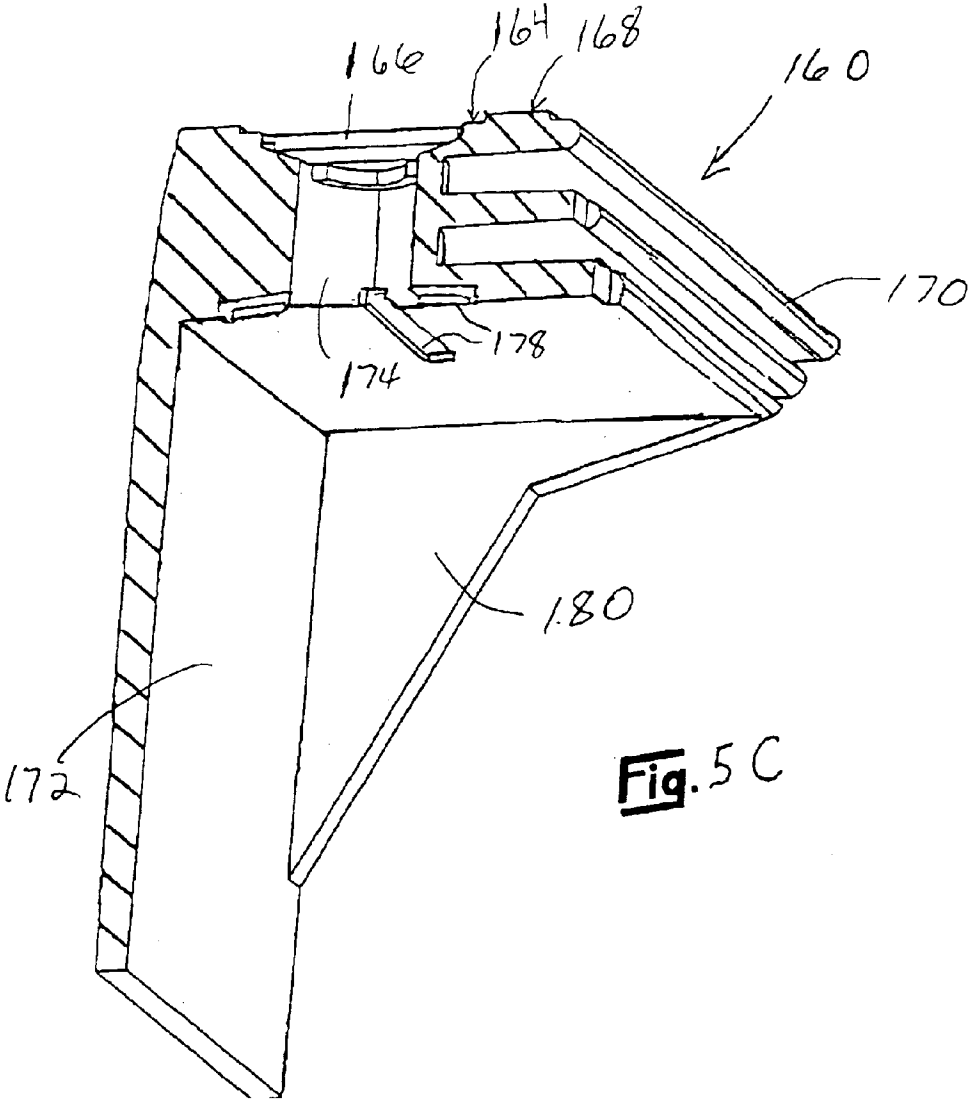
FIG. 5C is a partial sectional view in perspective through a portion of the substrate carrier of FIGS. 5A and 5B.

FIG. 5C provides a partial sectional view in perspective of carrier 160 through ink supply chamber 174. As shown in FIG. 5C, ink supply chamber 174 is cylindrical through the body of the carrier 160 up to just adjacent the well base 164. Just below the well base, there is a transition from the cylindrical chamber to the rectangular ink feed slot 166. Other features of carrier 160 are as described above.

Side 172 and gussets 180 are provided to guide and secure a separate ink reservoir to the carrier 160. Alignment holes or notches 182 and 184 may be included to align the reservoir to the carrier 160 and, if desired, separate notches or detent holes may be provided to removably attach the reservoir to the carrier 160.

Carriage positioning devices 186 are also included on the carrier 160 adjacent at least one side 172 thereof for accurately aligning the carrier 160 in a printer carriage.

In the foregoing carrier design, the carrier mass is substantially increased over the carriers illustrated in FIGS. 1–4. Accordingly, carrier 160 may function to provide increased heat sink capability or thermal transfer capability due to its increased mass. Carriers of the foregoing design having relatively high thermal conductivities are expected to readily absorb heat from the semiconductor chips during printing operations and effectively transfer heat to the surrounding atmosphere.

Regardless of the particular design of the substrate carrier described above, it is preferred to coat the carrier with a corrosion resistant material, particularly when the carrier is formed from a metal or metal containing composite. The coating thickness should be minimized in order to maximize conductive heat transfer from the substrates to the carrier and to maximize convective heat transfer from the carrier to the surrounding atmosphere. A coating thickness of ranging from about 0.1 to about 20 microns is preferred.

A preferred coating material is a poly(xylylene) which is available from Specialty Coating Systems of Indianapolis, Ind. under the tradename PARYLENE which polymerzes out of a vapor phase onto the carrier. A description of poly(xylylene), the processes for making these compounds and the apparatus and coating methods for using the compounds can be found in U.S. Pat. Nos. 3,246,627 and 3,301,707 to Loeb, et al. and U.S. Pat. No. 3,600,216 to Stewart, all of which are incorporated herein by reference as if fully set forth.

Another preferred coating which may be used to protect a metal carrier or metal composite carrier is silicon dioxide in a glassy or crystalline form. An advantage of the silicon dioxide coating over a poly(xylylene) coating is that silicon dioxide has a higher thermal conductivity than poly (xylylenes) and thus a greater coating thickness can be used. Another advantage of silicon dioxide is that it provides a surface having high surface energy thus increasing the adhesiveness of glues or adhesives to the coated surface. The coating thickness of the silicon dioxide coating ranges from about 2 to about 12 microns.

A carrier may be coated with silicon dioxide by a spin on glass (SOG) process using a polymeric solution available from Allied Signal, Advanced Materials Division of Milpitas, Calif. under the tradename ACCUGLASS T-14. This material is a siloxane polymer that contains methyl groups bonded to the silicon atoms of the Si—O polymeric backbone. A process for applying a SOG coating to a substrate is described, for example, in U.S. Pat. No. 5,290,399 Reinhardt and U.S. Pat. No. 5,549,786 to Jones et al. incorporated herein by reference as if fully set forth.

The carrier may also be coated with silicon dioxide using a metal organic deposition (MOD) ink which is available from Engelhard Corporation of Jersey City, N.J. The MOD ink is available as a solution in an organic solvent. The MOD process is generally described in U.S. Pat. No. 4,918,051 to Mantese et al. After coating the carrier, the coating is dried and fired to burn off the organic component leaving silicon that reacts with oxygen to form silicon dioxide or other metal silicates on the surface of the carrier.

Polymeric materials such as phenol-formaldehyde resins and epoxies may also be applied to the carrier to protect the carrier from corrosion. Such materials are generally applied from an aqueous or organic solution or emulsion containing the polymeric material. Any of the foregoing corrosion protection materials may be applied to the carrier using a variety of techniques including dipping, spraying, brushing, electrophoretic processes. An electrostatic process for applying the corrosion protection material as a dry powder may also be used to coat the carrier.

Regardless of the coating and coating technique used, it is preferred to use a coating and coating process which provides a layer of the coating having a thickness that is substantially uniform over the entire carrier. The coating should be adaptable to intricate shapes and features of the carrier so that there is essentially no uncoated surface of the carrier. The selected coating also should be chemically inert with respect to the ink and provide a substantially impervious layer which resists migration or water or ink components through the coating to the carrier.

Having now described the invention and preferred embodiments thereof, it will be recognized by those of ordinary skill that the invention is capable of numerous modifications, rearrangements and substitutions without departing from the spirit and scope of the invention as defined by the appended claims.

What is claimed is:

1. A substrate carrier for an ink jet printer comprising a molded or cast metal body containing a substantially planar substrate surface and four sides essentially perpendicular to the substrate surface, the substrate surface including one or more substrate locator wells each having a well base for attaching thereto one or more semiconductor substrates, at least one ink feed slot in the base of the well for flow of ink from an ink reservoir attached to the body of the carrier through a cylindrical ink feed chamber in the body to the ink feed slot, the ink feed chamber being disposed on an opposing side of the substrate carrier from the substrate locator well, wherein at least one of the four sides has a substantially planar surface devoid of fins extending from the substrate surface essentially perpendicular thereto for containing contact pads for electrical contact form a printer to the substrates on the body, and at least two of the four sides contain cooling fins.

2. The carrier of claim 1 wherein the metal comprises aluminum or zinc.

3. The carrier of claim 2 further comprising a coating or layer of silicon dioxide thereon.

4. The carrier of claim 3 wherein the coating or layer of silicon dioxide has a thickness ranging from about 0.1 to about 2.5 microns.

5. The carrier of claim 2 further comprising a coating or layer of poly(xylylene) thereon.

6. The carrier of claim 5 wherein the coating or layer of poly(xylylene) has a thickness ranging from about 0.1 to about 10 microns.

7. The carrier of claim 1 further comprising an ink reservoir body removably attached to the carrier for flow of ink through the ink chamber to a semiconductor substrate attached to the well base.

8. The carrier of claim 1 wherein the at least one side further comprises one or more notches for removably attaching an ink reservoir to the carrier.

* * * * *

UNITED STATES PATENT AND TRADEMARK OFFICE

CERTIFICATE OF CORRECTION

PATENT NO. : 6,820,959 B1
DATED : November 23, 2004
INVENTOR(S) : Donald Norman Spitz et al.

It is certified that error appears in the above-identified patent and that said Letters Patent is hereby corrected as shown below:

Column 10,
Line 26, replace "form" with -- from --.

Signed and Sealed this

Nineteenth Day of April, 2005

JON W. DUDAS
*Director of the United States Patent and Trademark Office*